US010919676B2

(12) United States Patent
Smitshoek

(10) Patent No.: US 10,919,676 B2
(45) Date of Patent: Feb. 16, 2021

(54) LID WITH VENTILATION SYSTEM

(71) Applicant: EMM Holding B.V., Zwolle (NL)

(72) Inventor: Tom Smitshoek, Enschede (NL)

(73) Assignee: EMM HOLDING B.V., Zwolle (NL)

( * ) Notice: Subject to any disclaimer, the term of this patent is extended or adjusted under 35 U.S.C. 154(b) by 74 days.

(21) Appl. No.: 16/401,307

(22) Filed: May 2, 2019

(65) Prior Publication Data

US 2020/0346824 A1 Nov. 5, 2020

(51) Int. Cl.
*B65D 51/16* (2006.01)
*B05B 7/24* (2006.01)
*B05B 15/63* (2018.01)

(52) U.S. Cl.
CPC ..... *B65D 51/165* (2013.01); *B05B 7/247* (2013.01); *B05B 7/2478* (2013.01); *B05B 15/63* (2018.02)

(58) Field of Classification Search
CPC ..... B65D 51/165; B65D 51/1644; B65D 51/1633; B05B 7/247; B05B 7/2402; B05B 7/2478; B05B 15/63; B05B 15/65; B05B 15/60
USPC ..... 220/203.2, 203.29, 203.19, 203.01, 202, 220/368, 367.1, 259.3, 256.1; 239/372, 239/337
See application file for complete search history.

(56) References Cited

U.S. PATENT DOCUMENTS

2006/0102550 A1 5/2006 Joseph et al.
2007/0018016 A1 1/2007 Yechouron
2008/0011879 A1 1/2008 Gerson et al.
2013/0001322 A1 1/2013 Pellegrino et al.
2013/0292493 A1* 11/2013 Marsalek ..... B05B 11/0044 239/379
2014/0103143 A1* 4/2014 Lin ..... B05B 7/2478 239/379
2014/0262899 A1* 9/2014 Mociak ..... B65D 51/1683 206/459.1
2016/0303594 A1 10/2016 Nyaribo et al.
2018/0009581 A1* 1/2018 Cheng ..... B05B 7/2408

FOREIGN PATENT DOCUMENTS

DE 202015003663 U1 * 9/2016 ..... B05B 7/0815
GB 904664 A * 8/1962 ..... B65D 51/1644
GB 2168314 A * 6/1986 ..... B65D 47/06

* cited by examiner

*Primary Examiner* — Robert J Hicks

(74) *Attorney, Agent, or Firm* — Miller, Matthias & Hull LLP

(57) ABSTRACT

A lid, for attachment to a container holding a liquid for use with a liquid spraying device, a vent duct defining a vent conduit extending through a lid body from a duct inlet end to a duct outlet end. A valve is disposed in the vent duct and is configured to permit air flow in a first direction, from the duct inlet end to the duct outlet end, while preventing liquid flow in a second direction opposite the first direction. A cap extends over the duct inlet end, the cap including a cap interior surface defining an interior air chamber, communicating with the vent conduit, and at least a first passage, communicating between the interior air chamber and a first cap inlet. A tube is coupled to the duct outlet end and has a tube outlet end fluidly communicating with an interior of the container.

16 Claims, 5 Drawing Sheets

LID WITH VENTILATION SYSTEM

BACKGROUND

Technical Field

The present disclosure generally relates to a lid for a container to be connected to a liquid spraying device, and in particular a lid with a ventilation system for venting the container.

Description of the Related Art

Liquid spraying devices may use different techniques to transport liquid from a container to a spraying mechanism. In general, suction feed liquid spraying devices and gravity feed liquid spraying devices are known. For suction feed liquid spraying devices, the container is generally located below the spraying mechanism and the liquid is sucked up from the container and to the spraying mechanism using negative pressure. In the case of gravity feed liquid spraying devices, the container is generally located above the spraying mechanism and the liquid can flow from the container towards the spraying mechanism under gravity. Regardless of the type of liquid spraying device, it is desirable to have an uninterrupted flow of liquid from the container to the spraying mechanism to achieve a uniform application of the liquid onto a surface to be treated.

WO 2005/077543 A1 describes a container for a gravity feed liquid spraying device with a vent opening at the bottom of the container, wherein the vent opening is closed when the container is filled with liquid and is opened after the complete spraying device is turned upside down so that the container is positioned above the spraying mechanism for spraying. However, opening and closing the vent opening at the correct point in time is cumbersome and may cause problems, such as liquid leaving the container, if the vent opening is not closed correctly.

WO 2009/046806 A1 describes a lid for a container of a gravity feed liquid spraying device. The lid is provided with a vent opening constructed as a labyrinth seal formed by three cylinders being plugged into each other. The labyrinth seal is intended to prevent liquid from flowing out of the container both when the container is in its upright position and when the container is inverted during the liquid spraying process. However, the labyrinth seal does not always prevent liquid from flowing past the labyrinth seal, particularly when the container is inverted. Moreover, the labyrinth seal protrudes from the lid, such that the lid cannot be stored in a space-saving manner.

SUMMARY OF THE DISCLOSURE

The embodiments disclosed herein provide a container with a ventilation system for venting the container which reliably prevents liquid from flowing out of the container during use.

According to certain aspects of this disclosure, a lid is provided for attachment to a container holding a liquid for use with a liquid spraying device. The lid includes a lid body defining an exterior surface and an interior surface, and an adapter extending from the exterior surface of the lid body and configured to releasably couple with the liquid spraying device, the adapter defining a liquid conduit extending through the lid body. The lid further includes a vent duct defining a vent conduit extending through the lid body, the vent duct including a duct inlet end extending from the exterior surface of the lid body and a duct outlet end extending from the interior surface of the lid body. A valve is disposed in the vent duct and is configured to permit air flow in a first direction, from the duct inlet end to the duct outlet end, while preventing liquid flow in a second direction opposite the first direction. A cap extends over the duct inlet end, the cap including a cap interior surface defining an interior air chamber, communicating with the vent conduit, and at least a first passage, communicating between the interior air chamber and a first cap inlet. A tube is coupled to the duct outlet end.

The ventilation system provides a reliable venting of the container without risk of liquid flowing out through the ventilation system, as the ventilation system does not require opening or closing during use of the liquid spraying device. The tube serves as an extension of the ventilation hole into the inside of the container and is sealed at a proximal end by the valve in a liquid tight manner. The valve prevents liquid from flowing out of the container into the ventilation system during use, i.e. during the refilling process, as the spraying device is inverted from the filling position to the spraying position, and during the spraying process. In addition, it is possible to easily refill the container by removing the lid from the container together with the ventilation system.

The liquid used for the spraying process may be any flowable material including, but not limited to, one of color, paint, coating, glue, or chemicals.

According to certain aspects of this disclosure, the tube is sized to have a tube outlet end located above a liquid level in the container during operation by means of a gravity feed liquid spraying device. In general, the container may be formed by a lid and a container. For filling the container, the container is placed on its bottom and the liquid to be sprayed is filled in the container through an opening at the opposite side of the container, i.e. opposite to the bottom. In subsequent steps, the opening is closed by the lid to form the receptacle and the receptacle is connected to the spraying device. When the receptacle and the spraying device are inverted, some liquid flows into the lid and the spraying device. Consequently, in this inverted position, the container is not completely filled with the liquid. Therefore, a tube with a suitable length will have a tube outlet end located above the liquid level when the container is upside down and the spraying device is in operation.

In general, the lid with the ventilation system may consist of one, two, three or more pieces. The lid, the tube, and the valve can be formed in one piece. This does not necessarily mean that the ventilation system is produced in one piece. The components of the ventilation system such as the tube and the valve may be produced separately but permanently assembled, e.g. glued to form one piece. However, it is also possible that at least some of the components are removably connected to each other and therefore form several pieces.

BRIEF DESCRIPTION OF THE DRAWINGS

In the following, the disclosure is further described by reference to the schematic illustrations shown in the figures, wherein.

The drawings are not necessarily to scale and that the disclosed embodiments are sometimes illustrated diagrammatically and in partial views. In certain instances, details which are not necessary for an understanding of the disclosed methods and apparatus or which render other details difficult to perceive may have been omitted. It should be understood, of course, that this disclosure is not limited to the particular embodiments illustrated herein.

DETAILED DESCRIPTION

Figure 1:
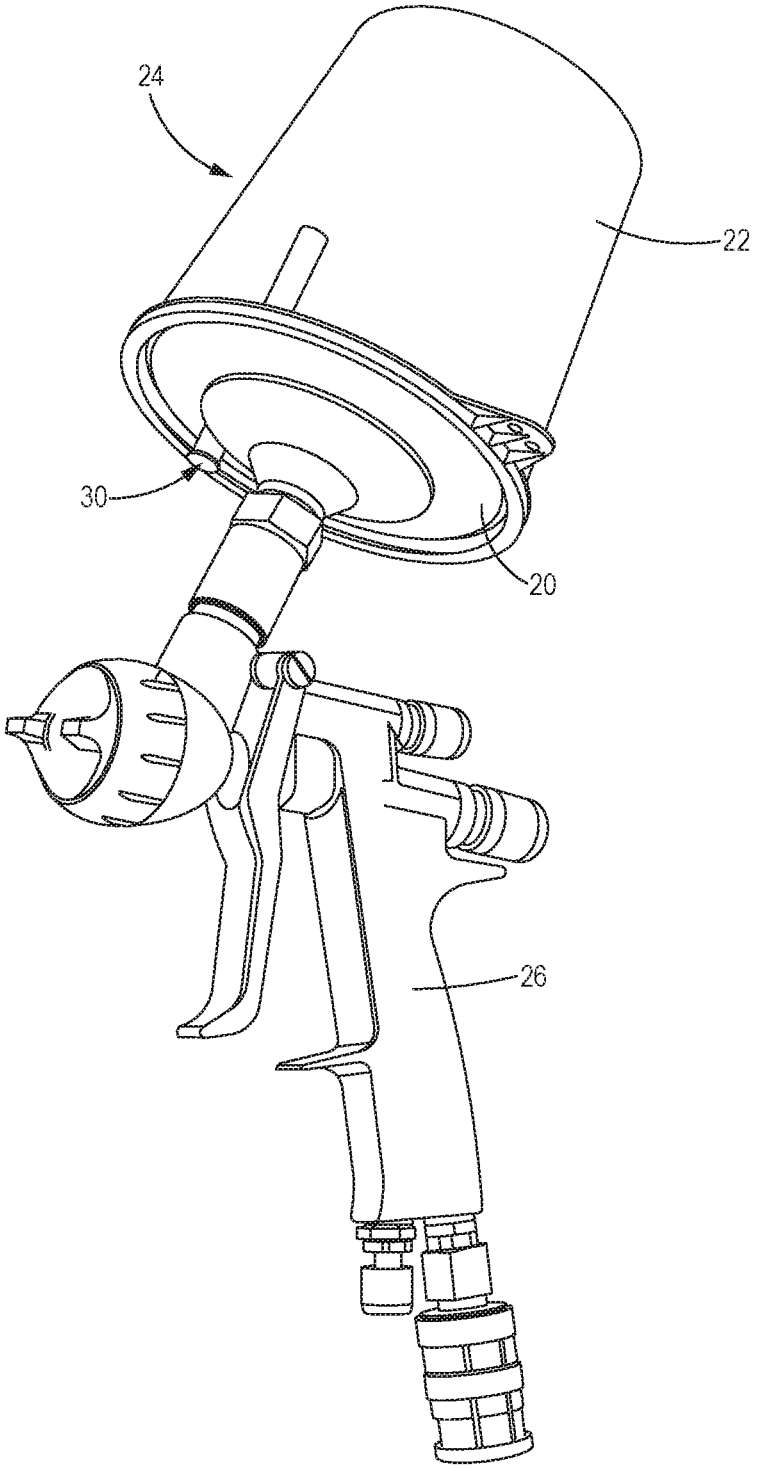
FIG. 1 is a perspective view of a liquid spraying device with receptacle according to the present disclosure.

FIG. 1 shows a lid 20 according to the present disclosure connected to a container 22 to form an enclosed receptacle 24 for holding a liquid to be dispensed. The lid 20 and container 22 are inverted and attached to a gravity feed liquid spraying device 26. The lid 20 includes a ventilation system 30 for selectively permitting ambient air to flow into the receptacle 24.

Figure 2:
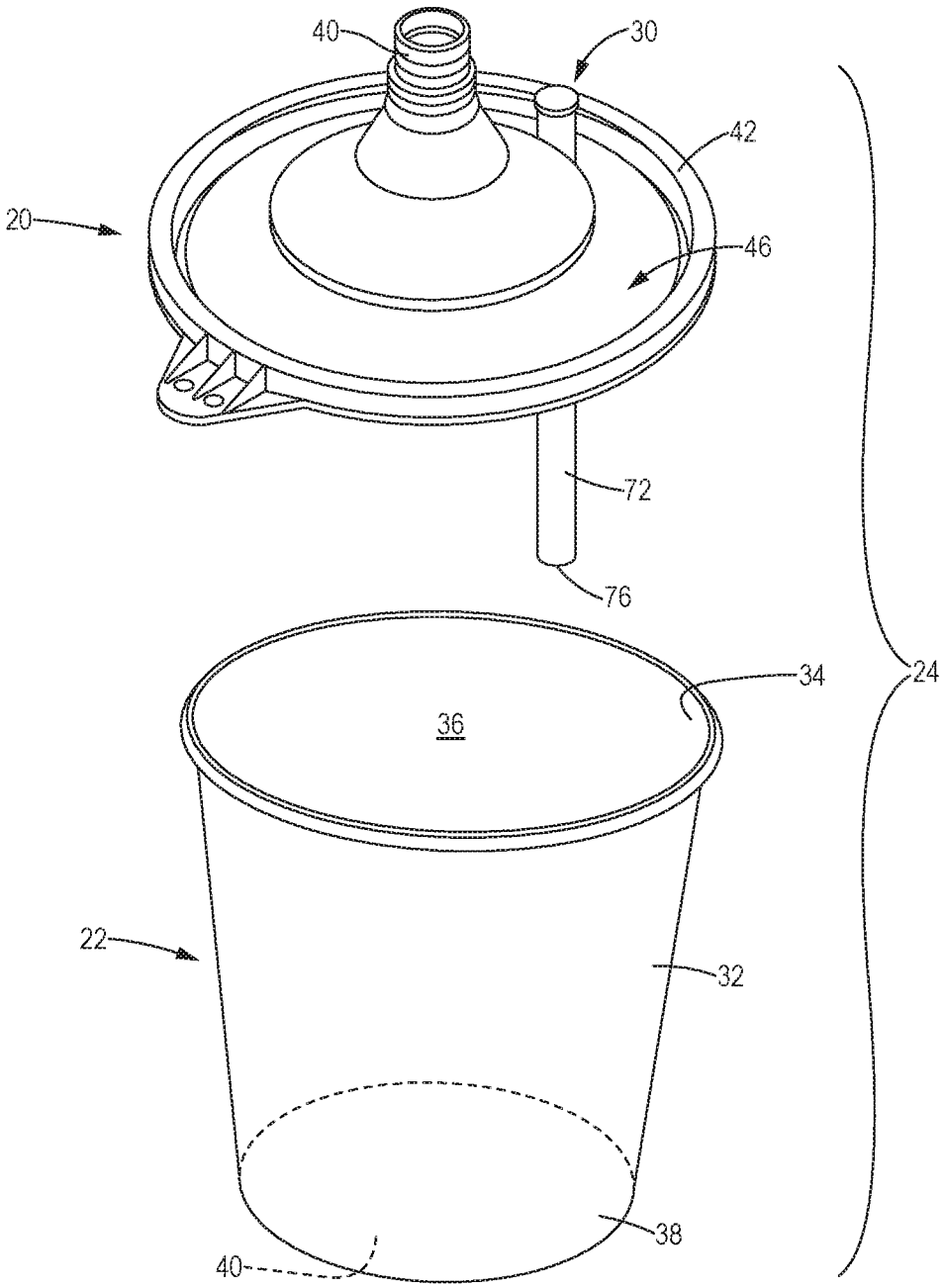
FIG. 2 is an exploded view of the receptacle of FIG. 1, showing a container and a lid constructed according to the present disclosure.
Figure 3:
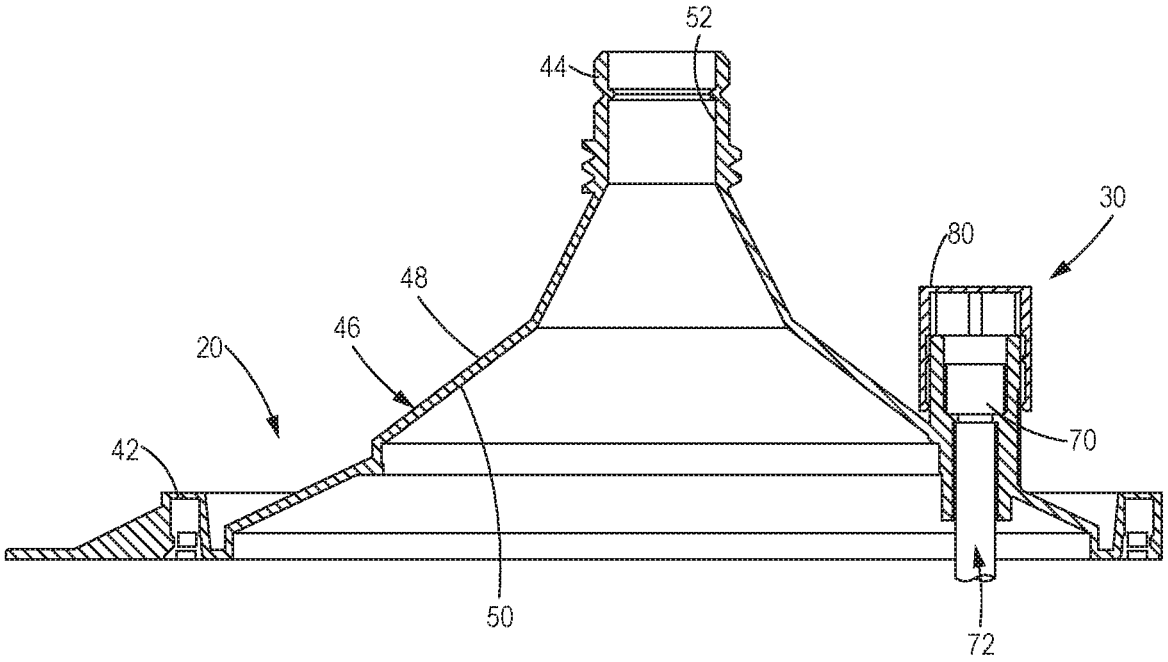
FIG. 3 is an enlarged side elevation view, in cross-section, of the lid of FIG. 2 including a ventilation system according to the present disclosure.

FIGS. 2 and 3 illustrate the lid 20 and container 22 in greater detail. The container 22 includes a side wall 32 having an open upper end 34, defining an opening into an interior 36 of the container 22, and a bottom end 38 closed off by a bottom wall 40. The lid 20 includes an outer rim 42, sized to sealably engage the upper end 34 of the container 22, and an adapter 44 for releasably engaging the liquid spraying device 26. A lid body 46 extends between the outer rim 42 and the adapter 44 to define a lid exterior surface 48, facing away from the container 22, and a lid interior surface 50, facing toward the interior 36 of the container 22 (FIG. 3). The adapter 44 defines a liquid conduit 52 extending through the lid body 46 for communicating liquid from the interior 36 of the container 22 to the liquid spraying device 26.

Figure 4:
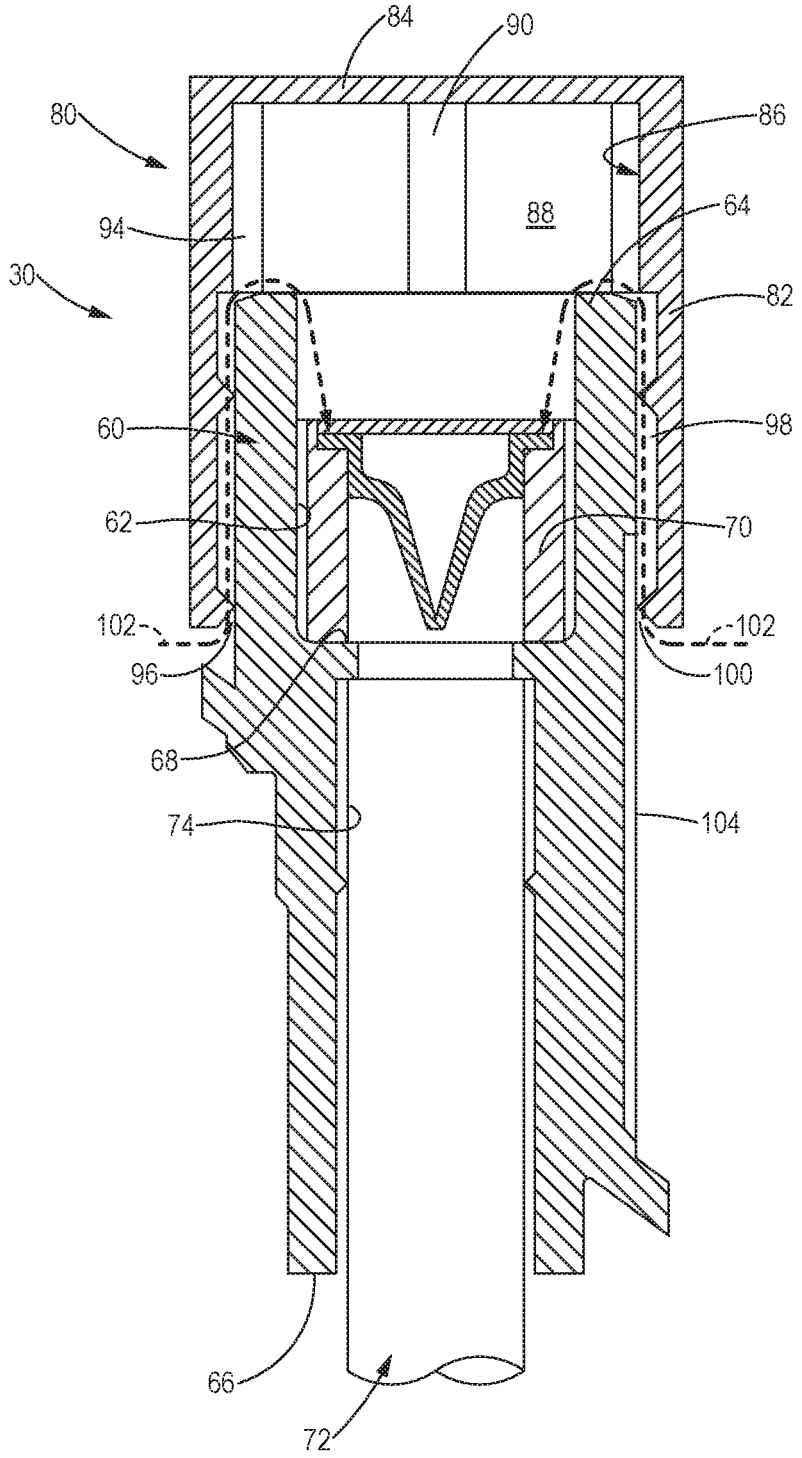
FIG. 4 is an enlarged side elevation view, in cross-section, of the ventilation system of FIG. 3.

The lid 20 carries the ventilation system 30, as best shown in FIGS. 2-4. The ventilation system 30 includes a vent duct 60 formed in the lid 20 and defining a vent conduit 62 extending through the lid body 46. The vent duct 60 includes a duct inlet end 64, extending from the exterior surface 48 of the lid body 46, and a duct outlet end 66, extending from the interior surface 50 of the lid body 46. The vent duct 60 further defines a valve seat 68 positioned between the duct inlet end 64 and the duct outlet end 66.

The ventilation system 30 also includes a valve 70 for permitting ambient air to flow into the receptacle 24 while preventing a reverse flow of liquid from the receptacle 24 to the surrounding environment. As best shown in FIGS. 3 and 4, the valve 70 is positioned in the valve seat 68 of the vent duct 60. In some examples, the valve 70 is a duckbill valve that permits air flow in a first direction, from the duct inlet end 64 to the duct outlet end 66, while preventing liquid flow in a second direction opposite the first direction.

The ventilation system 30 further includes a tube 72 for communicating with the interior 36 of the container 22. More specifically, the tube 72 includes a tube inlet end 74, coupled to the duct outlet end 66, and a tube outlet end 76 (FIG. 2) opposite the tube inlet end 74. The tube 72 is configured to maintain the tube outlet end 76 adjacent the bottom end of the container 22. For example, the tube 72 may be formed of a rigid material with a length sufficient to place the tube outlet end 76 adjacent the bottom end 38. Depending on the volume of fluid in the container 22, the tube outlet end 76 may be positioned above a liquid level in the container 22 when inverted during use with the gravity feed liquid spraying device 26.

Figure 5:
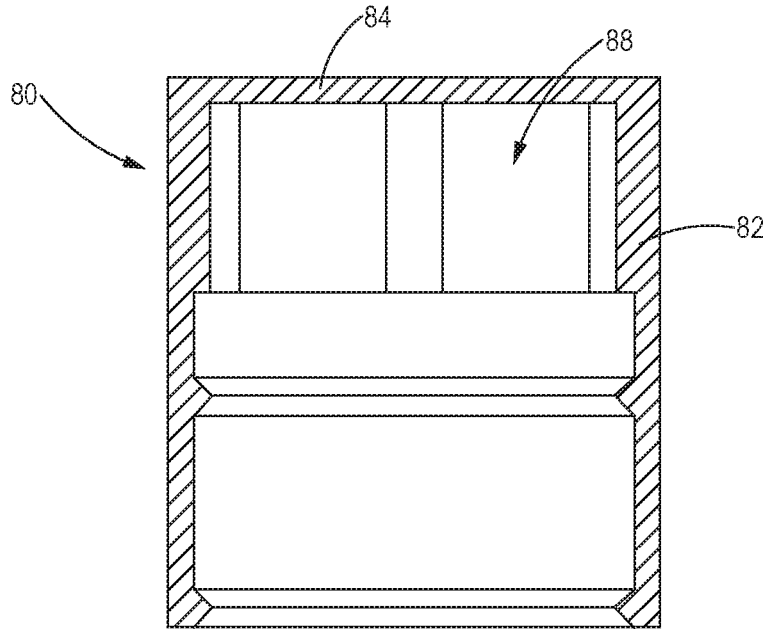
FIG. 5 is a side elevation view, in cross-section, of a cap of the ventilation system of FIG. 4.
Figure 6:
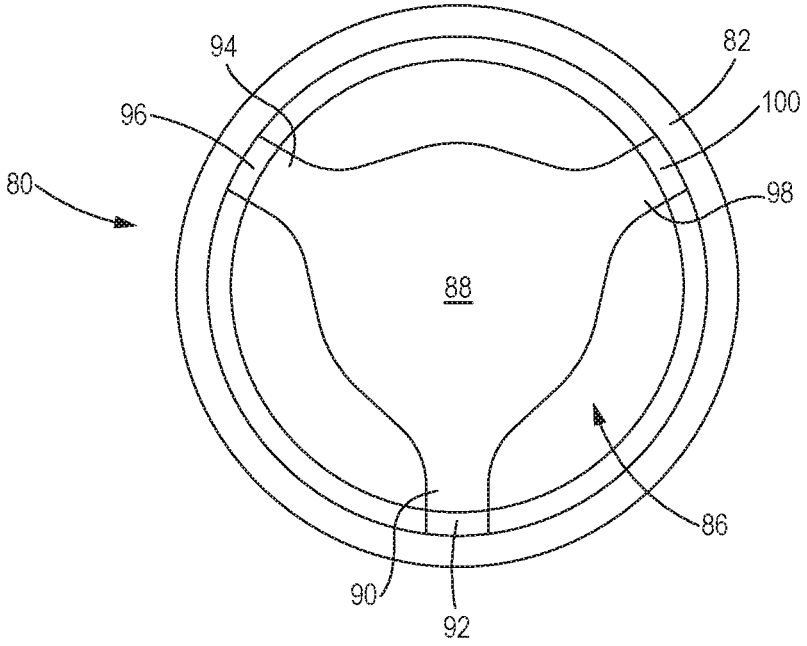
FIG. 6 is a bottom view of the cap, taken along line 6-6 of FIG. 5.

Still further, the ventilation system 30 includes a cap 80 for retaining the valve 70 in place and providing ventilation passages. As best shown in FIG. 4-6, the cap 80 includes a cap side wall 82 having an open bottom end and a top end closed off by a cap end wall 84. The cap end wall 84 extends over the duct inlet end 64. The cap side wall 82 and cap end wall 84 define a cap interior surface 86 that forms an interior air chamber 88 located above the duct inlet end 64 and communicating with the vent conduit 62. The cap interior surface 86 further forms at least a first passage 90 that fluidly communicates between the interior air chamber 88 and a first cap inlet 92 open to the surrounding environment. In the illustrated embodiment, the cap interior surface further defines a second passage 94, fluidly communicating between the interior air chamber 88 and a second cap inlet 96, and a third passage 98, fluidly communicating between the interior air chamber 88 and a third cap inlet 100. The first passage 90, second passage 94, and third passage 98 define vent flow paths 102 through which ambient air may flow into the ventilation system 30. An interior of the cap side wall 82 may be sized to frictionally engage an exterior surface 104 of the vent duct 60, thereby not only securing the cap 80 on the vent duct 60 but also retaining the valve 70 in position within the vent duct 60.

In operation, with the receptacle 24 coupled to the liquid spray device 26 and inverted, a pressure inside the receptacle 24 will drop as liquid is dispensed by the liquid spray device 26. When the pressure inside the receptacle 24 is sufficiently below ambient pressure outside the receptacle 24, the valve 70 will permit ambient air to flow into the container 22 via the vent flow paths 102, the valve 70, and the tube 72. Reverse flow of liquid may be prevented when the tube outlet end 76 is located above the liquid level inside the receptacle 24. Should the liquid level inside the receptacle 24 be above the tube outlet end 76, or should liquid somehow otherwise enter the tube 72, the one-way action of the valve 70 will prevent further egress of liquid out of the receptacle 24. Still further, the interior air chamber 88 of the cap 80 may store a volume of fluid, providing additional leakage protection.

All references, including publications, patent applications, and patents, cited herein are hereby incorporated by reference. The description of certain embodiments as "preferred" embodiments, and other recitation of embodiments, features, or ranges as being preferred, is not deemed to be limiting, and the claims are deemed to encompass embodiments that may be presently considered to be less preferred. All methods described herein can be performed in any suitable order unless otherwise indicated herein or otherwise clearly contradicted by context. The use of any and all examples, or exemplary language (e.g., "such as") provided herein, is intended to illuminate the disclosed subject matter and does not pose a limitation on the scope of the claims. Any statement herein as to the nature or benefits of the exemplary embodiments is not intended to be limiting, and the appended claims should not be deemed to be limited by such statements. More generally, no language in the specification should be construed as indicating any non-claimed element as being essential to the practice of the claimed subject matter. The scope of the claims includes all modifications and equivalents of the subject matter recited therein as permitted by applicable law. Moreover, any combination of the above-described elements in all possible variations thereof is encompassed by the claims unless otherwise indicated herein or otherwise clearly contradicted by context. The description herein of any reference or patent, even if identified as "prior," is not intended to constitute a concession that such reference or patent is available as prior art against the present disclosure.

What is claimed is:

1. A lid for attachment to a container holding a liquid for use with a liquid spraying device, the lid comprising:

a lid body defining an exterior surface and an interior surface;

an adapter extending from the exterior surface of the lid body and configured to releasably couple with the liquid spraying device, the adapter defining a liquid conduit extending through the lid body;

a vent duct defining an vent conduit extending through the lid body, the vent duct including a duct inlet end extending from the exterior surface of the lid body and a duct outlet end extending from the interior surface of the lid body;

a valve disposed in the vent duct and configured to permit air flow in a first direction, from the duct inlet end to the duct outlet end, while preventing liquid flow in a second direction opposite the first direction;

a cap extending over the duct inlet end, the cap including a cap interior surface defining an interior air chamber, communicating with the vent conduit, and at least a first passage, communicating between the interior air chamber and a first cap inlet; and a tube coupled to the duct outlet end.

2. The lid of claim 1, in which the tube includes a tube inlet end, coupled to the duct outlet end, and a tube outlet end opposite the tube inlet end, and in which the tube is configured to maintain the tube outlet end adjacent a bottom end of the container.

3. The lid of claim 1, in which the cap interior surface further defines a second passage, communicating between the interior air chamber and a second cap inlet, and a third passage, communicating between the interior air chamber and a third cap inlet.

4. The lid of claim 1, in which the duct inlet end defines a valve chamber, and in which the valve is disposed in the valve chamber.

5. The lid of claim 4, in which the valve comprises a duckbill valve.

6. The lid of claim 1, in which the cap includes a cap end wall extending over the duct inlet end and joined to a cap side wall.

7. The lid of claim 6, in which the cap side wall engages an exterior surface of the vent duct.

8. The lid of claim 6, in which the cap side wall is sized to frictionally engage the exterior surface of the vent duct, thereby retaining the valve within the vent duct.

9. Apparatus for holding a liquid with a liquid spraying device, the apparatus comprising:

a container; and a lid releasably coupled to the container, the lid including:

a lid body defining an exterior surface and an interior surface;

an adapter extending from the exterior surface of the lid body and configured to releasably couple with the liquid spraying device, the adapter defining a liquid conduit extending through the lid body;

a vent duct defining an vent conduit extending through the lid body, the vent duct including a duct inlet end extending from the exterior surface of the lid body and a duct outlet end extending from the interior surface of the lid body;

a valve disposed in the vent duct and configured to permit air flow in a first direction, from the duct inlet end to the duct outlet end, while preventing liquid flow in a second direction opposite the first direction;

a cap extending over the duct inlet end, the cap including a cap interior surface defining an interior air chamber, communicating with the vent conduit, and at least a first passage, communicating between the interior air chamber and a first cap inlet; and a tube coupled to the duct outlet end.

10. The apparatus of claim 9, in which the tube includes a tube inlet end, coupled to the duct outlet end, and a tube outlet end opposite the tube inlet end, and in which the tube is configured to maintain the tube outlet end adjacent a bottom end of the container.

11. The apparatus of claim 9, in which the cap interior surface further defines a second passage, communicating between the interior air chamber and a second cap inlet, and a third passage, communicating between the interior air chamber and a third cap inlet.

12. The apparatus of claim 9, in which the duct inlet end defines a valve chamber, and in which the valve is disposed in the valve chamber.

13. The apparatus of claim 12, in which the valve comprises a duckbill valve.

14. The apparatus of claim 9, in which the cap includes a cap end wall extending over the duct inlet end and joined to a cap side wall.

15. The apparatus of claim 14, in which the cap side wall engages an exterior surface of the vent duct.

16. The apparatus of claim 14, in which the cap side wall is sized to frictionally engage the exterior surface of the vent duct, thereby retaining the valve within the vent duct.

* * * * *